United States Patent [19]

Jourdan

[11] Patent Number: 5,000,235

[45] Date of Patent: Mar. 19, 1991

[54] FILLING MACHINE

[75] Inventor: James K. Jourdan, North Fon Du Lac, Wis.

[73] Assignee: FMC Corporation, Chicago, Ill.

[21] Appl. No.: 453,369

[22] Filed: Dec. 21, 1989

Related U.S. Application Data

[63] Continuation of Ser. No. 222,456, Jul. 21, 1988, abandoned.

[51] Int. Cl.[5] ..... B65B 3/04

[52] U.S. Cl. ..... 141/86; 141/88; 141/129; 141/311 A; 141/142; 141/147; 141/168; 141/191; 198/834

[58] Field of Search ..... 198/803.14, 803.15, 198/834, 845, 831; 222/305, 307; 141/86, 88, 93, 129, 140–144, 147, 153, 168, 189, 191, 281, 282, 311 A

[56] References Cited

U.S. PATENT DOCUMENTS

| | | | |
|---|---|---|---|
| 1,418,590 | 6/1922 | McBride | 148/834 |
| 2,038,695 | 4/1936 | Wilmot | 198/834 |
| 2,654,522 | 10/1953 | Gorham | 141/86 |
| 3,107,703 | 10/1963 | Smith | 141/86 |
| 3,217,944 | 11/1965 | Bell et al. | 141/129 X |
| 3,554,412 | 1/1971 | Hayashi et al. | 141/144 X |
| 3,889,726 | 6/1975 | Stigler | 141/142 |
| 4,089,406 | 5/1978 | Teske et al. | 198/834 X |
| 4,192,359 | 3/1980 | Pippin | 141/129 X |
| 4,355,669 | 10/1982 | Miller | 141/147 |

FOREIGN PATENT DOCUMENTS

| | | | |
|---|---|---|---|
| 87/02643 | 5/1987 | PCT Int'l Appl. | 141/129 |

*Primary Examiner*—Ernest G. Cusick

*Attorney, Agent, or Firm*—R. C. Kamp; R. B. Megley

[57] ABSTRACT

A rotatable gravity filler capable of high speed filing of containers sealable with lids having a sprocket for providing stable support for each container, a shield disk to catch and removed drips, and a gate arrangement which closes tightly to prevent drips but is easily removable for cleaning.

8 Claims, 4 Drawing Sheets

FILLING MACHINE

This application is a continuation of application Ser. No. 222,456, filed 7/21/88, now abandoned.

This invention relates to deposit-fill-seal machinery, generally, and more particularly, to such machinery that use containers which require a clean lip for accepting a lid or closure.

Fillers, such as granular fillers, for example, deposit food stuffs into containers and are then covered by a closure or lid which is sealed to the container. A common method for effecting the seal between the container and the closure is the application of heat under pressure for a specified length of time. However, the seal will be ineffective and the resulting package defective, if the sealing area around the periphery of the container, i.e., the seal lip, is contaminated by food falling onto the sealing area. The present invention addresses this problem in several ways by assuring that the seal area of the container remains clean and free from food stuffs. The present invention also provides a means for convenient cleaning of the filler, which is necessary when changing product and to maintain a clean and sterile environment.

These and other attributes of the present invention, and many of the attendant advantages thereof, will become more readily apparent from a perusal of the following description and the accompanying drawings, wherein.

Figure 1:
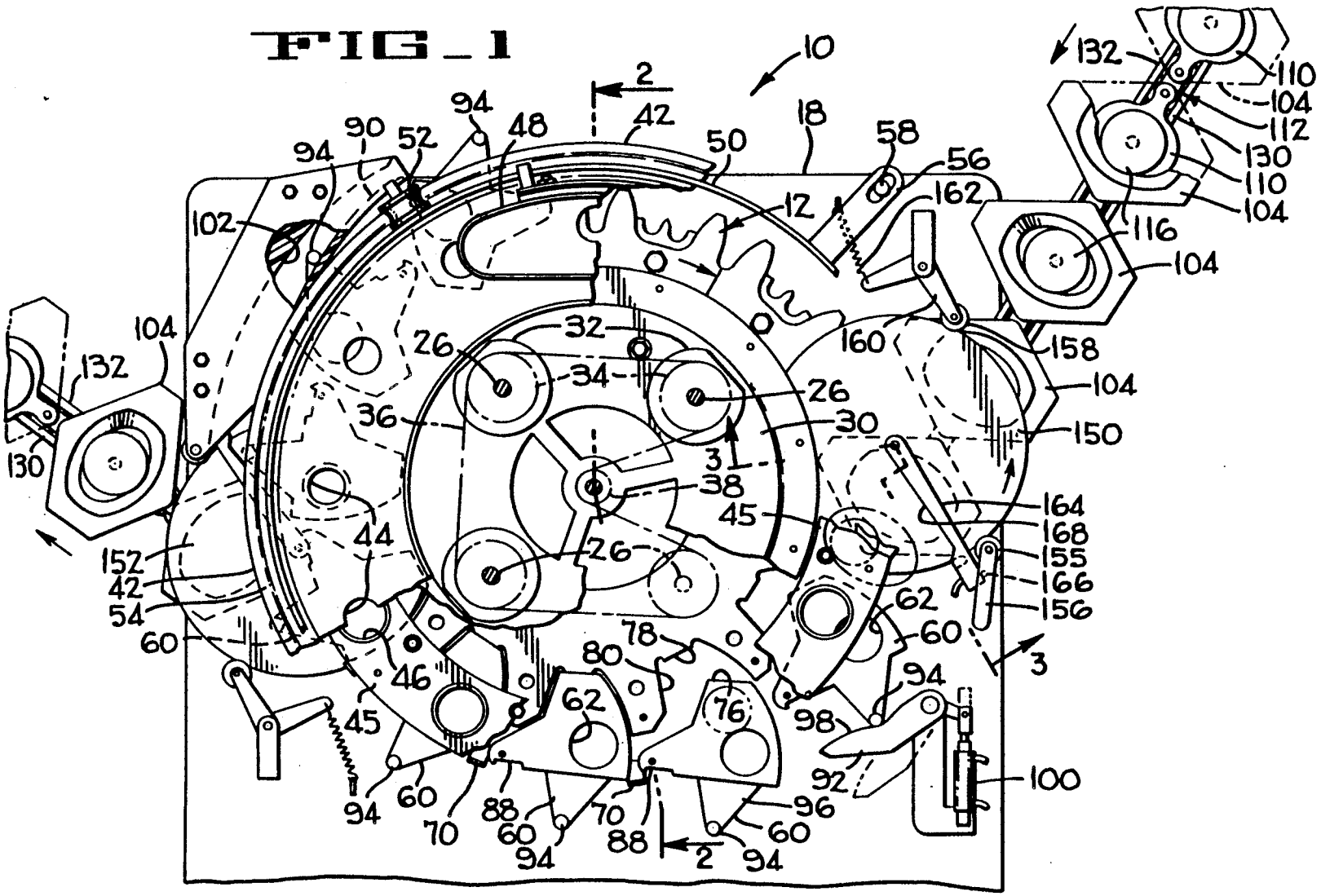
FIG. 1 is a top plan view, with portions broken away for clarity, of a filler according to the present invention.
Figure 2:
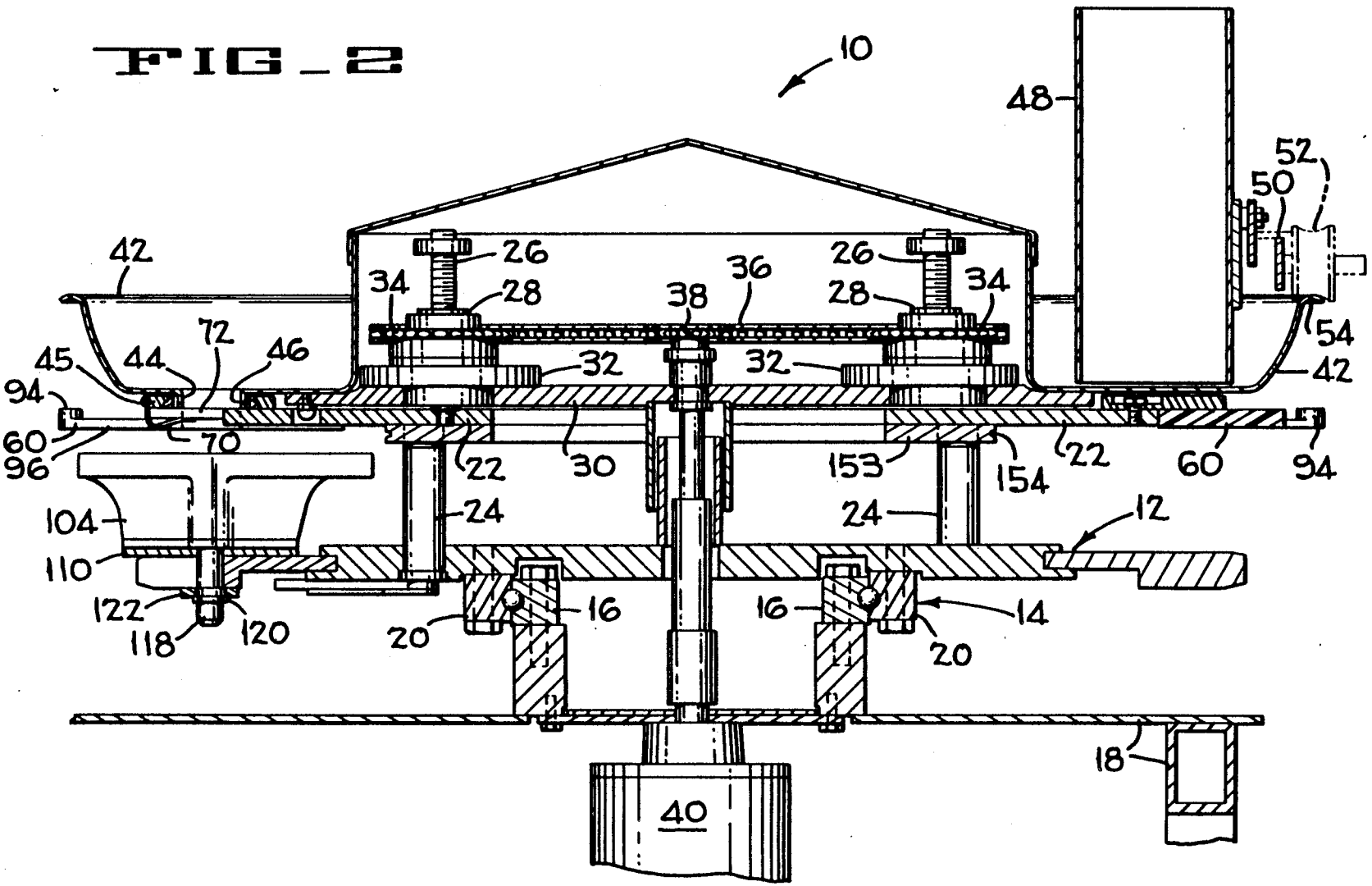
FIG. 2 is a cross sectional view taken on line 2—2 of FIG. 1.

Referring now to FIGS. 1 and 2, there is shown a granular filler, indicated generally at 10, having a drive sprocket 12 which is rotatably supported by a large diameter roller bearing 14 with its inner race 16 indirectly secured to and supported from a rigid base, a portion of which is shown at 18, and its outer race 20 secured to drive sprocket 12. A ring mount 22 is secured to, and elevated above, the drive sprocket 12 by a plurality of posts 24 carried by the drive sprocket 12. The posts 24 transmit the rotational motion of the drive sprocket 12 to the ring mount 22, so that the ring mount rotates therewith, and elevate the ring mount 22 above the sprocket to provide clearance for the next carried by the chain, to be explained hereinafter. A plurality of threaded posts 26 are rigidly secured to and carried by the ring mount 22. A threaded sleeve 28 engages each of the threaded posts 26 and has an outward extending flange (not shown) which is trapped between the fill top support 30 and a retainer 32 attached to the support 30. The threaded sleeves 28 can rotate relative to the posts 26, and thereby move vertically thereon, and can rotate relative to the retainer 32 and the support 30, but cannot move vertically relative thereto and thereby move the support 30 vertically as the sleeves are moved vertically. Each of the sleeves 28 is keyed or otherwise secured to a sprocket 34. A chain 36 is trained around the sprockets 34 and a drive sprocket 38, which is driven by a bi-directional air motor 40. Rotation of the motor will cause the threaded sleeves 28 to rotate on the fixed threaded posts 26 which will cause the support 30 to be raised or lowered, depending on the direction of rotation of the motor 40. This arrangement for vertical adjustment of the fill top support 30 relative to the ring mount 22 is conventional and provides a means for varying the fill volume.

An annular fill top 42 is secured to the fill top support 30 and is provided with a plurality of uniformly spaced upper measuring cups 44. Corresponding lower measuring cups 46 are carried by and sit in complementary holes in, a support ring 45 secured to the upper side of the ring mount 22; the tops of the lower measuring cups 46 being flush with the upper surface of the support ring 45. The lower cups 46 slidingly engage the upper cups 44. When the fill top support 30, which is shown in FIG. 2 in its lowermost position, is raised by rotation of the air motor 40, the upper cup 44 will telescope upward relative to the lower cup 46, thereby increasing the volume of fill. The cups are filled by passing under a fill hopper 48 which has an open bottom permitting the granular material to fall, under the influence of gravity, into the cups. The hopper 48 is supported from an accessory ring 50 which is, in turn, supported by rollers 52 riding on the rim 54 of the fill top 42. A slotted torque arm 56 is attached to the ring 50, with a rigid pin 58 extending from the base 18 through the slot to keep the accessory ring 50, and hence the hopper 48, from rotating with the fill top while maintaining a relatively constant clearance between bottom of the hopper 48 and the fill top. The ability of the accessory ring 50 to move a slight amount both vertically and laterally accommodates imperfection in the rotational plane and in the circular form of the fill top while keeping the distance between the hopper and the fill top relatively constant.

Figure 5:
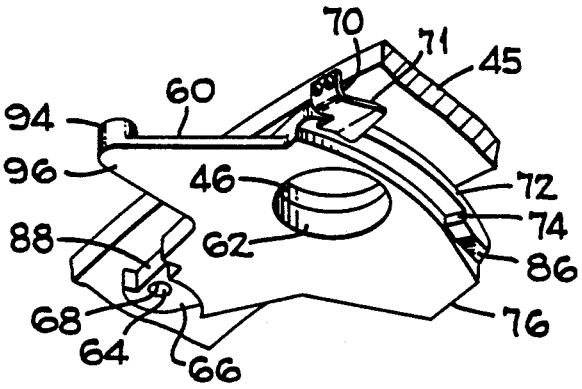
FIG. 5 is a detailed isometric view of a gate and the associated retainer.

A gate 60 is provided for each of the cups with each gate pivotally mounted on the lower side of the support ring 45. The gates 60 are pivoted between an outward or closed position in which the gate engages the underneath side of the lower cup 46 and blocks material from falling therefrom, and an inward or open position in which the lower cup 46 is aligned with an opening 62 formed in the gate in which material in the upper and lower cup are deposited, under the influence of gravity, into a container. The mounting for each gate 60 is best shown in FIG. 5. A pin 64 is affixed to the lower side of the support ring 45 and extends downward. The gate 60 has a reduced thickness extension 66 with a hole 60 therethrough which is capable of accepting the pin 64 and defines therewith a pivot axis for the gate 60. A retainer 70 is secured to the outer edge of the support ring 45 and engages the extension 66 to hold the gate 60 on the pin 64. The retainer 70 is provided with a lateral extension 71 which engages a reduced thickness portion 72 o the adjacent gate. The reduced thickness portion 72 is formed as a circular arc centered on the hole 68. A stop 74 is formed as an abrupt increase in thickness and serves to position the gate 60 in its outward position. The inward position of the gate 60 is determined by the flat section 76 which engages a flat stop section 78 formed in the cut out 80 provided in the ring mount 22 to accommodate the gate 60. The retainer 70 is formed, as shown on the left of FIG. 2, to be elastically deformed when engaging the portion 72 and the extension 66, which are both substantially the same thickness, to exert an upward spring force on the gate 60 to hold it in tight engagement with the lower surface of the support ring 45. Assembly and disassembly is facilitated by a notch 88 formed in the extension 66 having a width and length to accommodate the amount of the overlap with the retainer 70. To assemble the gate, it is positioned with the notch 88 registered with the retainer 70 and moved upward with the pin 64 engaging the hole 68 in the gate 60. The gate is then rotated about the pin 64 counterclockwise, as seen in FIG. 1, which will cause one retainer to engage the extension 66 and the extension 71 of the adjacent retainer will be cammed downward by the ramp 86 until the stop 74 is cleared and the extension will then engage the portion 72. The gate 60 will thus be held tightly against the support ring 45.

The position of the gate is determined by a closing cam 90 and an opening cam 92. The gate is provided with a follower rod 94 attached to and extending upward from an arm 96 formed on the gate 60. The gates 60 are moved to their outward or closed positions by the closing cam 90 as the sprocket 12 is rotated.

After the cups have been filled by passage under the hopper 48, the gates are opened by the follower rod 94 engaging the cam surface 98 of the opening arm 92. The arm 92 cams the gates inward to their open position so the material filling the cups will drop under the influence of gravity into the containers positioned therebelow. The arm 92 is pivotally mounted and can be swung to an inoperative position, as shown by dotted lines in FIG. 1, by an air cylinder 100 in response to a sensor, not shown, indicating that a container is missing. In the aforementioned operative position the appropriate gate moves past the arm 92 without contacting the cam surface 98 and the gate remains in its outward, closed position. The closing cam 90 is shaped to accommodate an already closed gate, by simply allowing the rod 94 to move therethrough, i.e. the outer surface 102 of the cam 90 is a circular arc having a radius at least equal to the radius traced by the rod 94 on an open gate.

Figure 8:
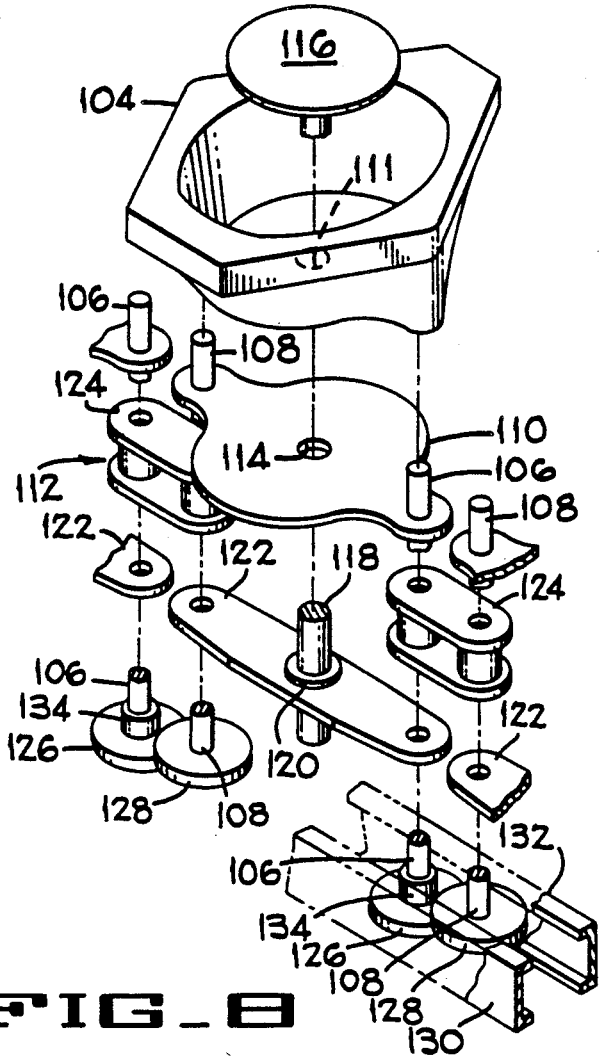
FIG. 8 is an expanded view of the chain shown in FIG 6.

The containers, not shown, may be formed of plastic material with a shape to conform with the cavity of a nest 104, as shown in FIG. 8, and having a lip which rings the nest cavity and overlays the upper surface thereof. The nest 104 is provided with a pair of holes which register with pins 106 and 108 and position the nest on an upper link 110 of a chain 112. The upper link 110 generally conforms with the lower plan form of the nest 104 and provides support therefor. An ejector disk 116, which functions to elevate or eject the container from the nest 104 after filling, lidding and sealing, is affixed to a rod 118 which extends through a hole 111, which also functions as a bearing, in the nest 104, through a hole 114 in upper link 110 and through a bearing 120 in a lower link 122. The ejector disk 116 engages the bottom of the nest 104 to limit downward travel. The lower end of the rod 118 extends below the lower link a distance sufficient to permit a container to be removed from the nest 104, when the rod is cammed or otherwise moved upward. The pins 106 and 108 extend through the upper link 110, a conventional chain link 124 and the lower link 122 and pivotally connect the upper and lower links to the conventional chain links on each side thereof. The pins 106 and 108 are of equal length and also extend below the lower link. Rollers 126 and 128 are identical and are rotatably mounted by bearings 134 on the ends of the pins 106 and 108 respectively; the bearing on roller 126 being on the upper side thereof and the bearing on roller 128 being on the lower side so that the rollers 126 and 128 overlap but do not touch each other. A pair of parallel guide tracks 130 and 132 are positioned on both the entrance and exit side of the filler 10; the inner track 132 being tangent to the pitch circle of the sprocket 12. The tracks 130 and 132 are positioned a distance apart just slightly greater than the diameter of the rollers 126 and 128. The rollers hold the chain relatively rigid but permit the link 124 to take a slightly angled position relative to the tracks. The tracks terminate adjacent the sprocket and the small "slack" in the chain as the sprocket teeth engage the conventional links permits a smooth, i.e. without chordal action, entrance to and exit from the filler and well as other stations required in the process of making complete package. High speed processing without spillage is, therefore, possible because the changes in direction are not as abrupt, i.e. velocity changes occur over a greater time and acceleration forces are, therefore, lower.

Figure 6:
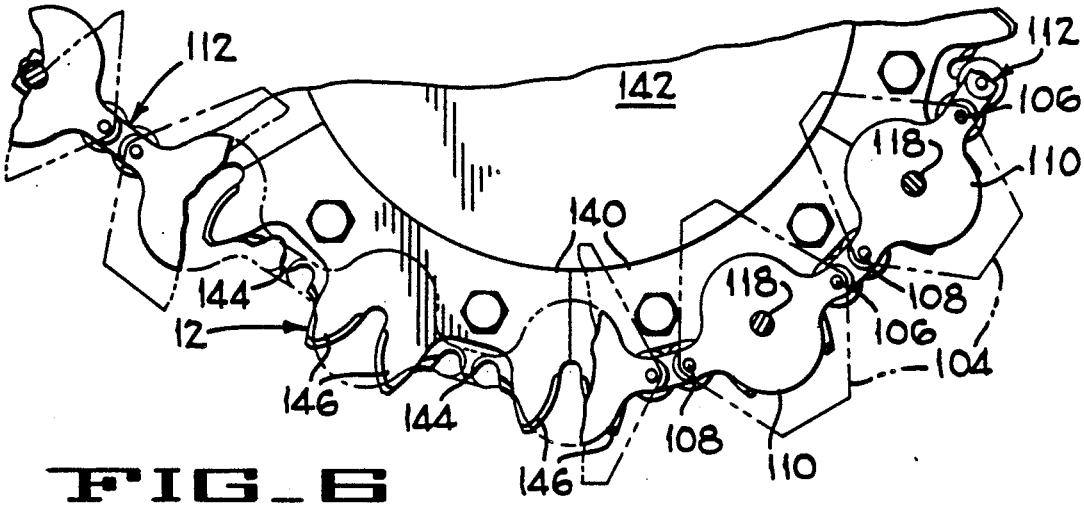
FIG. 6 is top plan view of a sector of the chain sprocket and the chain, with portions thereof broken away for clarity.
Figure 7:
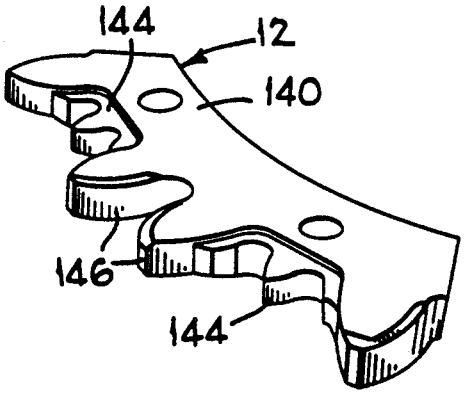
FIG. 7 is an isometric view of a portion of the sprocket shown in FIG. 6.

The sprocket 12 is shown in FIGS. 6 and 7 and comprises a plurality of sectors 140 bolted to a main support hub 142 for ease and lower cost of manufacture. Each sector is provided with teeth 144 which are engageable with the conventional chain links 124. The chain links 124 transmit the torque to the sprocket 12 through the teeth 144 to cause rotation of the filler 10. The teeth 144 are separated by a cantilevered beam 146 which is bifurcated to accept the ejector rod 118 without interference. The beam 146 has a thickness greater than that of the teeth 144 so that the beam will engage and provide support for the upper link 110 and the nest 104. The advantage of the beam 146 is that it can provide the total support for the nest and its container and that support can be provided without the need for stationary support rails. The only sliding contact encountered is between the upper link 110 and the beam 146 during entry to and exit from the sprocket 12, which is relatively slight.

Figure 3:
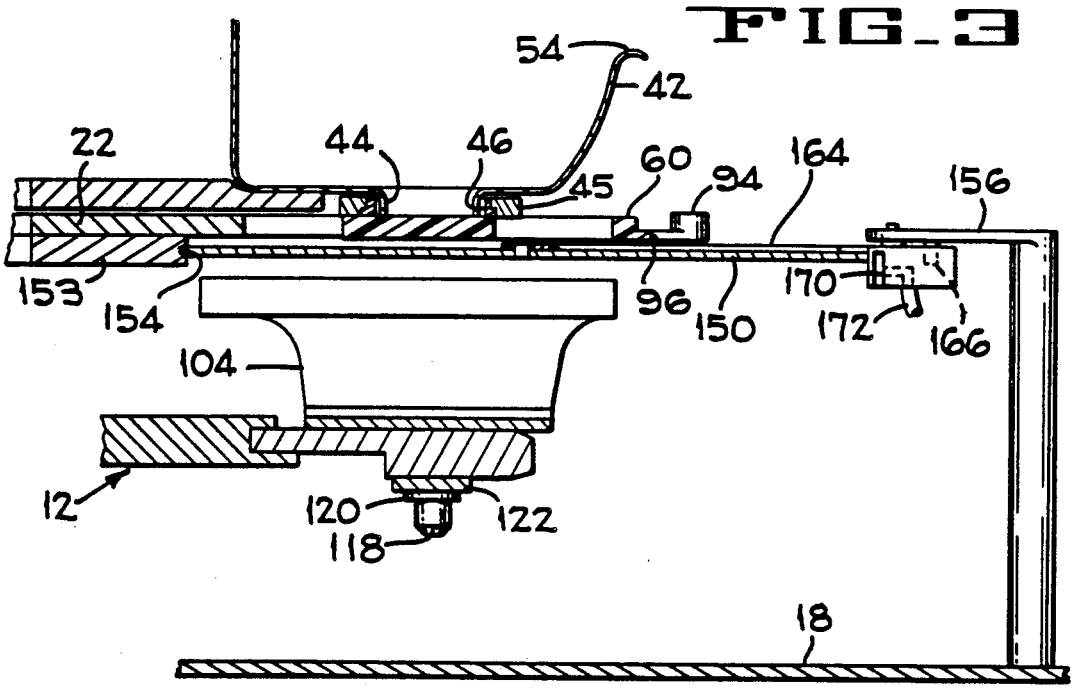
FIG. 3 is a cross sectional view taken on line 3—3 of FIG. 1.
Figure 4:
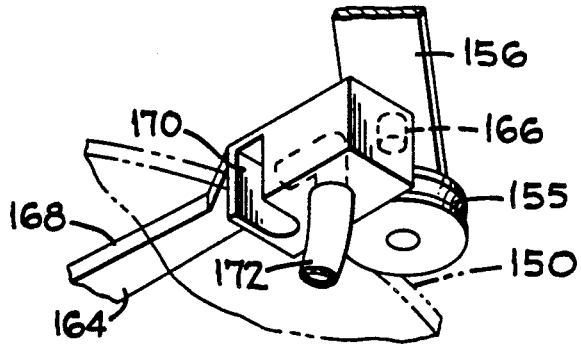
FIG. 4 is a detailed, isometric view of wiper arm and vacuum pickup for the protection disk shown in FIGS. 1 and 3.

Drip protection disks 150 and 152 are respectively provided on the entrance and exit sides of the filler 10. The purpose of these disks is to keep drips from falling on the seal lips of the containers. Since these two disks are similar, a detailed description of one will suffice for an understanding of both. As shown in FIG. 3, the disk 150 engages a groove 154 in a drive ring 153 attached to and rotating with the ring mount 22. The groove 154 not only provides a force to cause rotation of the disk 150 but also provides vertical support for the disk 150. A grooved idler roller 155, as seen in FIG. 1, is rotatably mounted on a fixed arm 156 rigidly supported from the base 18 of the filler 10. The disk 150 is held in place against the grooved roller 155 and the groove 154 of drive ring 153, to impart a friction drive force for rotation of the disk 150, by a grooved idler roller 158 rotatable mounted on one arm of a bell crank 160 pivoted from the base 18. A tension spring 162 acting on the other arm of the bell crank 160 urges the roller 158 against the groove 154 in the disk 150 and hence the disk against drive ring 153 and the roller 155. The groove 154 and the rollers 155 and 158 lie in an essentially horizontal plane so that the disk 150 is supported and rotates in a horizontal plane above the nests 104 and below the gate 60. Any drips from above fall onto the disk 150 as the chain moves the nests 104 and their individual containers into the filler 10. In order to prevent drips from the disk 150 onto the containers, a wiper arm 164 is rotatably pinned to the center of the disk 150 and slidably engages the top thereof. The outer end of the wiper arm 164 engages a pin 166 on the fixed arm 156 and prevents the wiper arm 164 from rotating with the disk 150. The leading edge 168 of the wiper arm 164, i.e. the left edge as viewed in FIG. 1 because the disk 150 rotates in a direction, as indicated by the arrow, opposite to the filler, directs any material, liquid or solid, toward the outer edge of the disk 150 because the leading edge is angled toward the central radius of the arm 164. The outer end of the arm has a vacuum block including a pickup opening 170 positioned adjacent the edge of disk 150 and connected to a vacuum line 172. Thus, any material that would otherwise fall onto the container seal lip as the containers are conveyed to the filler will be caught by the disk 150 and the wiper arm 164 will cause that material to be urged outward to the disk edge as the disk 150 is rotated where it will be sucked up by the vacuum at the pickup opening 170 on the wiper arm. The disk 152 will perform the same function in the same manner as the containers are conveyed away from the filler 10.

It can be seem that the present invention provides a means for keeping the seal lip of the container free from contamination, which includes a protection disk with a wiper arm and vacuum pickup, a sprocket and chain which provides a stable support for the container, a chain and track arrangement which minimizes acceleration forces, and thus reduces spillage, and a gate retainer which keeps a tight seal between the measuring cup and the gate, while making removal and replacement easy and quick.

While one embodiment of the present invention has been illustrated and described herein, it is to be understood that various changes may be made therein without departing from the spirit of the invention as defined by the scope of the appended claims.

What is claimed is:

1. A gravity filler having at least one measuring cup for depositing material therefrom into containers, each of which has a sealing lip, carried in nests by a chain comprising:

a sprocket attached to and capable of rotating said filler and having a plurality of teeth capable of engagement with said chain;

said sprocket capable of engaging said chain over less than 360 degrees to define an entrance and an exit of said chain to said sprocket;

a plurality of cantilevered beam means formed on said sprocket and spaced evenly between said teeth;

each of said plurality of beam means having a thickness greater than that of each of said plurality of teeth to provide a load bearing surface for said nests and containers as said chain traverses said filler by drivingly engaging said sprocket to rotate said filler;

a shield disk means rotatably mounted on said filler and driven by rotation of said filler and positioned over at least one of the entrance and exit of said chain to said sprocket to preclude drips from said filler from falling on said sealing lips;

a wiper arm pinned at its inner end to the center of said disk means and having its outer end fixed from rotation;

a vacuum block formed on the outer end of said arm;

said wiper arm engaging the upper surface of said disk means to urge material dripped onto said disk means toward said vacuum block;

a gate attached to and rotatable with said filler and swingable between open and closed positions below said measuring cup; and bias means engaging said gate to urge said gate into tight engagement with said measuring cup.

2. The invention according to claim 1, wherein each of said plurality of beam means extend radially beyond each of said plurality of teeth.

3. The invention according to claim 1, wherein said chain carries an ejector pin and each of said plurality of beam means is bifurcated to accommodate said ejector pin.

4. The invention according to claim 1, wherein the rotatable mounting of said disk means comprises:

a grooved driving ring attached to said filler and drivingly engaging said disk means and defining thereby a point of contact; and a pair of grooved idler rollers, each of which is positioned more than 90 degrees from said point of contact, engaging said disk means to provide support for said disk means.

5. The invention according to claim 4 wherein one of said pair of idler rollers is pivotally mounted on an arm and bias means urges said one idler roller toward said disk means.

6. A sprocket adapted for use with a chain of the type having conventional chain links separated by elongated links capable of supporting containers comprising:

a plurality of teeth positioned around the periphery of said sprocket to drivingly engage said conventional links;

a plurality of cantilevered beam means formed on said sprocket and positioned both radially and vertically between said plurality of teeth and engageable with said elongated links; and each of said plurality of beam means having a thickness greater than that of each of said plurality of teeth and extending radially beyond each of said plurality of teeth to provide a load bearing surface for said elongated links.

7. A drip shield adapted for use with a rotatable gravity filler comprising:

a disk means mounted on said filler and driven by rotation of said filler;

a wiper arm pinned at its inner end to the center of said disk means and having its outer end fixed from rotation;

a vacuum block formed on the outer end of said arm; and said wiper arm engaging the upper surface of said disk means to urge material dripped onto said disk means toward said vacuum block.

8. A gate arrangement adapted for use with a gravity filler comprising:

a plurality of gates each having a given thickness, a pivot hole, an arcuate portion on one end terminating in a stop, and an extension on the other end, and said arcuate portion having a thickness less than said given thickness and said extension having a thickness substantially the same as said given thickness;

a plurality of spring clips attached to said filler and positioned between adjacent ones of said plurality of gates so that each of said plurality of clips engages the extension of one of said adjacent gates and the reduced portion of the other of said adjacent gates.

* * * * *